US009899729B2

(12) United States Patent
Mai et al.

(10) Patent No.: US 9,899,729 B2
(45) Date of Patent: Feb. 20, 2018

(54) ANTENNA SYSTEM

(71) Applicants: Jianchun Mai, Shenzhen (CN); Chao Wang, Shenzhen (CN)

(72) Inventors: Jianchun Mai, Shenzhen (CN); Chao Wang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 162 days.

(21) Appl. No.: 15/011,458

(22) Filed: Jan. 29, 2016

(65) Prior Publication Data

US 2017/0012341 A1 Jan. 12, 2017

(30) Foreign Application Priority Data

Jul. 9, 2015 (CN) ..... 2015 2 0493051 U

(51) Int. Cl.

| | |
|---|---|
| ***H01Q 1/24*** | (2006.01) |
| ***H01Q 13/10*** | (2006.01) |
| ***H01Q 13/16*** | (2006.01) |
| ***H01Q 21/28*** | (2006.01) |

(52) U.S. Cl.

CPC ..... *H01Q 1/243* (2013.01); *H01Q 13/10* (2013.01); *H01Q 13/16* (2013.01); *H01Q 21/28* (2013.01)

(58) Field of Classification Search

CPC ..... H01Q 21/28; H01Q 1/24; H01Q 13/10
USPC ..... 343/702
See application file for complete search history.

(56) References Cited

U.S. PATENT DOCUMENTS

| | | | | |
|---|---|---|---|---|
| 9,026,187 | B2 * | 5/2015 | Huang | H05K 5/0086 455/41.1 |
| 2011/0001673 | A1 * | 1/2011 | You | H01Q 1/243 343/702 |
| 2012/0105287 | A1 * | 5/2012 | Jung | H01Q 1/243 343/702 |
| 2012/0176278 | A1 * | 7/2012 | Merz | H01Q 1/243 343/702 |
| 2013/0135158 | A1 * | 5/2013 | Faraone | H01Q 13/10 343/702 |
| 2014/0078008 | A1 * | 3/2014 | Kang | H01Q 5/35 343/702 |
| 2014/0375509 | A1 * | 12/2014 | Vance | H01Q 1/243 343/702 |
| 2017/0005393 | A1 * | 1/2017 | Wu | H01Q 1/243 |

* cited by examiner

*Primary Examiner* — Huedung Mancuso
(74) *Attorney, Agent, or Firm* — Na Xu; IPro, PLLC

(57) ABSTRACT

An antenna system applicable to a mobile communication device is provided in the present disclosure. The antenna system includes a metal shell with a metal frame and a metal back cover, a printed circuit board (PCB) housed in the metal shell, and an antenna part with a first feed point and a second feed point. A first break point and a second break point are formed at two opposite sides of the metal frame; a first gap and a second gap are respectively formed at two opposite sides of the metal back cover for defining a first clearance area and a second clearance area. The first feed point is located in the first clearance area and contacts a left frame portion of the metal frame; the second feed point is located in the second clearance area and contacts a right frame portion of the metal frame.

8 Claims, 2 Drawing Sheets

ANTENNA SYSTEM

FIELD OF THE DISCLOSURE

The present disclosure generally relates to mobile communication technologies, and more particularly, to an antenna system applicable to a mobile communication device.

BACKGROUND

With the development of mobile communication technologies, mobile communication devices such as mobile phones, tablet computers, or the like, are used more and more widely. Mobile communication devices with metal shells are preferred by people because of their fashion appearance as well as good durability.

In a typical mobile communication device, two parallel gaps are formed on a metal back cover thereof to enable a corresponding part of the metal cover to serve as an antenna radiator. However, the parallel gaps may impact the appearance and integrality of the metal shell, and also lower radiation efficiency of the antenna radiator.

Therefore, it is necessary to provide a new antenna system which can overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and an embodiment thereof.

Figure 1:
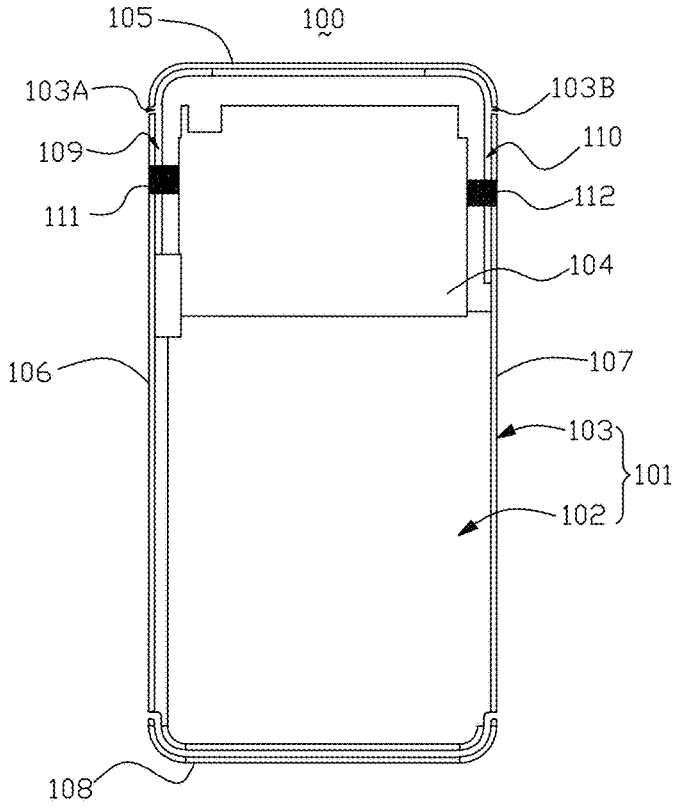
FIG. 1 is a planar view of an antenna system according to an exemplary embodiment of the present disclosure.
Figure 2:
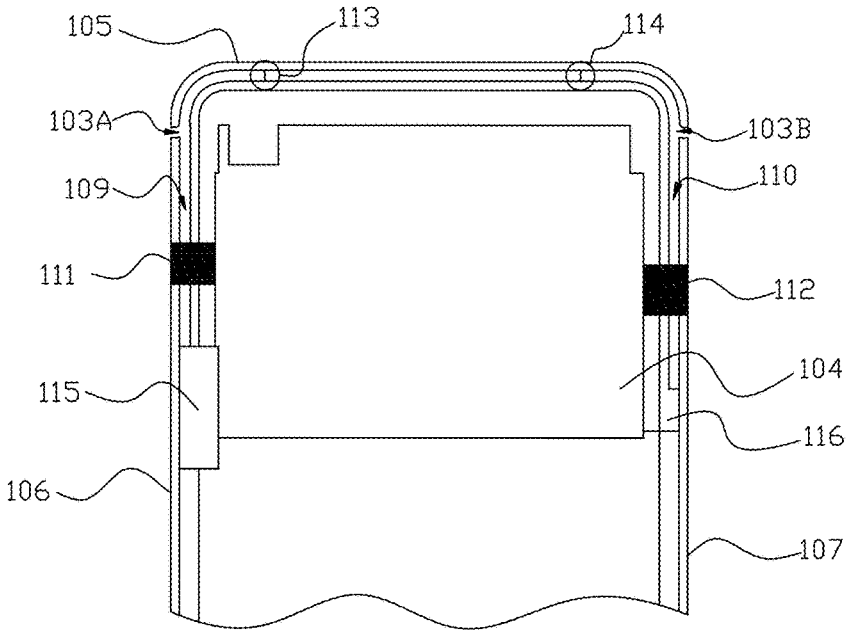
FIG. 2 is an enlarged, partial view of the antenna system of FIG. 1.

Referring to FIG. 1 and FIG. 2, an antenna system 100 according to an embodiment of the present disclosure includes a metal shell 101, a printed circuit board (PCB) 104 and an antenna part. The PCB 104 is housed in the metal shell 101, and includes at least one ground point; the antenna part is disposed on the PCB 104.

The metal shell 101 includes a metal back cover 102 and a metal frame 103. The metal back cover 102 is surrounded by the metal frame 103, and is connected to the metal frame 103. Moreover, a first break point 103A and a second break point 103B are symmetrically formed at two opposite sides of the metal frame 103, and the first break point 103A and the second break point 103B are configured for separating the metal frame 103 into a top frame portion 105 and a main frame assembly. In particular, the main frame assembly includes a left frame portion 106, a right frame portion 107 opposite to the left frame portion 106, and a bottom frame portion 108 opposite to the top frame portion 105.

A first gap 109 and a second gap 110 are respectively formed at two opposite sides of the metal back cover 102, and the first gap 109 and the second gap 110 are located adjacent to the top frame portion 105. In the present embodiment, both the first gap 109 and the second gap 110 are L-shaped gaps formed at edges of the metal back cover 102.

For example, the metal back cover 102 includes a top edge near the top frame portion 105, a left edge near the left frame portion 106, and a right edge near the right frame portion 107. The first gap 109 extends from the top edge of the metal back cover 102 to the left edge of the metal back cover 102, passing through a top left corner of the metal back cover 102 in an L-shaped manner. The second gap 110 extends from the top edge of the metal back cover 102 to the right edge of the metal back cover 102, passing through a top right corner of the metal back cover 102 also in an L-shaped manner.

The metal back cover 102, the left frame portion 106 and a left end of the top frame portion 105 are separated by the first gap 109 to form a first clearance area. The metal back cover 102, the right frame portion 107 and a right end of the top frame portion 105 are separated by the second gap 110 to form a second clearance area. The first break point 103A is communicated with the first clearance area, and the second break 103B is communicated with the second clearance area.

The antenna part includes a first feed point 111 and a second feed point 112, both of which are disposed on the PCB 104. The first feed point 111 is located in the first clearance area and contacts the left frame portion 106; the second feed point 112 is located in the second clearance area and contacts the right frame portion 107. Furthermore, the antenna part further includes a matching circuit and a plurality of ground points, and the matching circuit is electrically connected to the first feed point 111. The metal back cover 102 is electrically connected to the ground points on the PCB 104, and thus the metal back cover 102 is grounded entirely.

In the present embodiment, four ground points 113, 114, 115 and 116 are provided in the antenna system 100 as illustrated in FIG. 2, and the metal frame 103 is grounded through the four ground points 113, 114, 115 and 116. The matching circuit may include a first inductor, a capacitor and a second inductor. Both the capacitor and the second inductor are electrically connected in parallel with the first inductor. An inductance of the first inductor may be approximate 1 nH, a capacitance of the capacitor may be approximate 0.6 pF, and an inductance of the first inductor may be approximate 4.7 nH.

Figure 3:
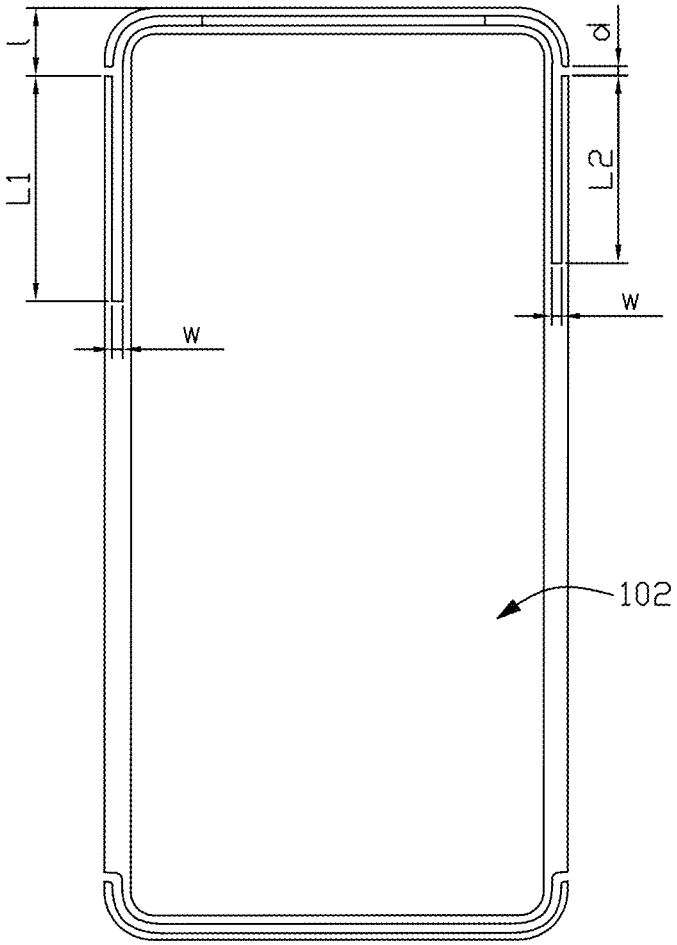
FIG. 3 is a rear view of the antenna system of FIG. 1.

Referring also to FIG. 3, a length L1 of the first clearance area, which extends from the first break point 103A along the left frame portion 106, is approximate 30.7 mm. A length L2 of the second clearance area, which extends from the second break point 103B along the right frame portion 107, is approximate 25.7 mm. Widths of the first clearance area and the second clearance area are both approximate 2 mm. Volumes of the first clearance area and the second clearance area are respectively related to corresponding antenna frequencies thereof.

In an exemplary embodiment of the present disclosure, the first feed point 111 serves as a GPS/WIFI antenna feed point, namely, a feed point provided for both a GPS antenna and a WIFI antenna. A frequency range of the GPS antenna is from 1570 MHz to 1610 MHz; a low frequency range of the WIFI antenna is from 2400 MHz to 2484 MHz, and a high frequency range of the WIFI antenna is from 5150 MHz to 5875 MHz. The second feed point 112 serves as a diversity antenna feed point, namely, a feed point provided for a diversity antenna. A frequency range of the diversity antenna is from 1805 MHz to 2170 MHz. As can be seen, the frequency range of the GPS/WIFI antenna is less than that of the diversity antenna, which means that a wavelength range of the GPS/WIFI antenna is greater than that of the diversity antenna. Therefore, a volume of the first clearance area corresponding to the GPS/WIFI antenna needs to be slightly greater than that of the second clearance area corresponding to the diversity antenna.

Furthermore, a furthest straight-line distance L between the top frame portion 105 and the first break point 103A or the second break point 103B is approximate 9.3 mm, and widths of both the first break point 103A and the second break point 103B are approximate 1.5 mm.

In the antenna system 100 as provided in the present disclosure, two gaps are respectively provided at two opposite sides of a top portion of the metal back cover 102 to form the first clearance area and the second clearance area, and both the first clearance area and the second clearance area are close to the metal frame 103 with a narrow width. With this configuration, integrality of the metal shell 101 can be maintained to ensure the mobile communication device to have a good appearance; moreover, the antenna system 100 can also have good isolation (e.g., less than −20 dB), and therefore, a radiation efficiency of the antenna system 100 can be improved.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna system, comprising:

a metal shell comprising a metal frame and a metal back cover surrounded by the metal frame;

a printed circuit board (PCB) housed in the metal shell; and an antenna part comprising a first feed point and a second feed point on the PCB;

wherein a first break point and a second break point are formed at two opposite sides of the metal frame for cooperatively separating the metal frame into a top frame portion and a main frame assembly comprising a left frame portion and a right frame portion; a first gap and a second gap are respectively formed at two opposite sides of the metal back cover near the top frame portion for defining a first clearance area and a second clearance area;

wherein the first feed point is located in the first clearance area and contacts the left frame portion, and the second feed point is located in the second clearance area and contacts the right frame portion;

wherein the first feed point serves as a GPS/WIFI antenna feed point; the second feed point serves as a diversity antenna feed point wherein a volume of the first clearance area is greater than that of the second clearance area for ensuring a wavelength range of the GPS/WIFI antenna feed point is greater than that of the diversity antenna feed point.

2. The antenna system of claim 1, wherein both the first gap and the second gap are L-shaped gaps.

3. The antenna system of claim 2, wherein the first gap extends from a top edge of the metal back cover near the top frame portion to a left edge of the metal back cover near the left frame portion, and the second gap extends from the top edge of the metal back cover to a right edge of the metal back cover near the right frame portion.

4. The antenna system of claim 3, wherein the metal back cover, the left frame portion and a left end of the top frame portion are separated by the first gap for forming the first clearance area; and the metal back cover, the right frame portion and a right end of the top frame portion are separated by the second gap for forming a second clearance area.

5. The antenna system of claim 4, wherein the first clearance area is communicated with the first break point; the second clearance area is communicated with the second break point.

6. The antenna system of claim 4, wherein a length of the first clearance area, which extends from the first break point along the left frame portion, is greater than a length of the second clearance area, which extends from the second break point along the right frame portion.

7. The antenna system of claim 1, wherein the antenna part further comprises a matching circuit electrically connected to the first feed point.

8. The antenna system of claim 7, wherein the matching circuit comprises a first inductor, a capacitor and a second inductor; both the capacitor and the second inductor are electrically connected in parallel with the first inductor.

* * * * *